US006182852B1

(12) United States Patent
Szwargulski et al.

(10) Patent No.: US 6,182,852 B1
(45) Date of Patent: Feb. 6, 2001

(54) CONTAINER AND METHOD OF MANUFACTURE

(75) Inventors: Carl J. Szwargulski, Ballwin; Kevin A. Leonard, Florissant; John W. Cooley; Thomas Brinkmann, both of Ballwin, all of MO (US)

(73) Assignee: Metal Container Corporation, St. Louis, MO (US)

( * ) Notice: Under 35 U.S.C. 154(b), the term of this patent shall be extended for 0 days.

(21) Appl. No.: 09/405,808

(22) Filed: Sep. 24, 1999

Related U.S. Application Data

(60) Provisional application No. 60/150,660, filed on Aug. 25, 1999.

(51) Int. Cl.[7] ..... B65D 7/42
(52) U.S. Cl. ..... 220/608; 220/609
(58) Field of Search ..... 220/608, 609; 215/373, 374

(56) References Cited

U.S. PATENT DOCUMENTS

| | | | |
|---|---|---|---|
| 1,679,676 | 8/1928 | Miele . | |
| 2,936,020 | 5/1960 | Thornburg et al. . | |
| 3,559,258 | 2/1971 | Gardner . | |
| 3,728,059 | 4/1973 | de Putter | 425/155 |
| 4,341,321 | 7/1982 | Gombas | 220/66 |
| 4,515,284 | 5/1985 | Lee, Jr. et al. | 220/70 |
| 4,885,924 | 12/1989 | Claydon et al. | 72/109 |
| 5,105,973 | 4/1992 | Jentzsch et al. | 220/606 |
| 5,325,696 | 7/1994 | Jentzsch et al. | 72/117 |
| 5,524,468 | 6/1996 | Jentzsch et al. | 72/117 |
| 5,593,063 * | 1/1997 | Claydon et al. | 220/608 |
| 5,605,248 * | 2/1997 | Jentzsch | 220/608 |
| B1 5,105,973 | 6/1998 | Jentzsch et al. | 220/606 |

OTHER PUBLICATIONS

CanTech International; Keeping Cans Competitive; Sep./Oct. 1998; Karen E. Kidwell, editor; pp 26–28.

* cited by examiner

*Primary Examiner*—Joseph M. Moy
(74) *Attorney, Agent, or Firm*—Carr & Storm, L.L.P.

(57) ABSTRACT

The invention includes a novel profile for a container bottom and method of manufacturing the improved bottom. The improvement involves the creation of an additional angled portion in the inner leg area of a container bottom during the formation of the bottom profile during the bodymaking step. Known container bottom profiles have a single portion in the inner leg area after the bodymaking process. The inventive profile includes the following discrete portions starting at the nose of the container bottom and working inwards towards the central axis: a nose, a substantially linear lower leg portion projecting upwards from the nose, a separate angled portion between the lower leg portion and the dome inclined generally at an angle more towards the longitudinal central axis of the container than the angle of the lower leg portion, and a dome.

7 Claims, 4 Drawing Sheets

CONTAINER AND METHOD OF MANUFACTURE

CROSS-REFERENCE TO RELATED APPLICATION

Provisional Application Filed: "CONTAINER BOTTOM PROFILE AND METHOD OF MANUFACTURE THEREOF," Ser. No. 60/150-660, filed Aug. 25, 1999 to which priority is claimed.

BACKGROUND OF THE INVENTION

1. Technical Field

This invention relates generally to the design and manufacture of aluminum containers as are commonly used for containment of beverages, and in particular to an improved bottom structure and process for manufacturing the improved bottom structure.

2. Background

Two piece aluminum containers have been used extensively for distributing beverages such as beer, carbonated soft drinks and other beverages such as tea. A large portion of the cost of delivering beverages to consumers in containers is the material cost. This has led to ongoing efforts in the industry to reduce the amount of material used in containers. The widespread use of such containers makes it possible to achieve large savings with what would otherwise appear to be a very small reductions in material requirements. These efforts are referred to within the industry as "lightweighting." Efforts to lightweight aluminum containers have focused on four areas: the bottom profile, the side wall, the neck area and the container lid.

Light weighting of the bottom profile generally involves either changing the geometry of the bottom as it is manufactured during the bodymaking process, modifying the bottom profile shape after the bodymaking process, or some combination of the two. Despite the efforts to lightweight aluminum containers, the need for a strong bottom has required substantial thickness be retained in the bottom to achieve required strengths. If the container bottom is not sufficiently strong the central dome area will be forced downward by the internal pressure of the contents until it reverses shape. This is referred to as dome reversal. As a practical matter, the dome on all aluminum containers manufactured for commercial use today will reverse at some finite pressure. The pressure at which the dome reverses is one criteria which is used to measure the strength of a particular bottom profile. This pressure is referred to as the "dome reversal pressure" or DRP. Design changes that increase the dome reversal pressure are the equivalent of design changes that permit light weighting of the container, since material thickness container be reduced while maintaining the required dome reversal pressure.

The bodymaking process includes the process steps of drawing and ironing. The bottom profile of a container is typically formed as the last step, in a pressing process that draws material to the required shape and dimensions. The bottom profile is formed when punch nose tooling, located on the bottom end of a punch on the interior of the container blank, is forced against a dome plug and outer retainer located on the opposite side of the container blank. The profile formed in the aluminum sheet feed stock will thus conform to match the intersection between the punch nose tooling, outer retainer, and the dome plug. Typically, the punch nose tooling has a coining surface which defines the point in the process where there is continuous contact between the dome plug tooling, the metal of the container blank, and the punch nose tooling.

During the creation of the bottom profile, the thickness of the aluminum in the center of the bottom is not significantly changed. Therefore, the thickness required for adequate bottom strength must be the thickness of the feed stock. The inability to improve the strength of the bottom creates a situation in which the bottom profile requirements determine the minimum acceptable feed stock thickness. Improvements in the side wall and neck area which could permit the use of thinner feed stocks cannot be implemented unless an improved bottom profile has been identified and a process for manufacturing containers with the improved profile defined. Thus, there remains a need for improved container bottom profiles and manufacturing methods therefore.

One known method of improving the strength of a bottom profile is to reform either the outside or inside area around the nose. U.S. Pat. No. 5,105,973, describes an inside reform process for improving the strength of the container. Reforming of the outside is also known.

Another limitation on known processes is that the inside diameter of the bottom profile is formed in a drawing process. In prior processes, a dome plug has been used to form a substantially linear inner leg portion between the nose and the dome. The inner leg is formed when the dome plug and opposing tooling known as the punch nose are pressed together with a metal container blank between them. The process requires sufficient clearance to allow the metal to flow between the opposing tooling without shearing and tearing. As a result of the clearances used in prior art processes, the inner leg portion, though linear, will angle slightly outwardly at the bottom, away from the longitudinal central axis 116 of the container when the dome plug tooling is removed. This occurs because the aluminum of the bottom is formed from the end of the punch nose tooling to the top of the dome plug which has a smaller diameter than the inside diameter of the inner leg portion of the punch nose tooling. The difference in diameter causes the inner leg to slant slightly toward the inner axis at the top.

BRIEF SUMMARY OF THE INVENTION

In accordance with the preferred embodiments, many of the disadvantages, shortcomings, and problems associated with previous container designs and methods of manufacturing have been substantially reduced or eliminated.

It has been considered by the inventors, that if the angularity of the inner leg to the longitudinal central axis 116 of the container could be made to approach zero, the dome reversal pressure would increase.

It has also been considered by the inventors, that if the inner leg length could be manufactured more vertically, and therefore as a cylinder portion, then there would be an increase in the dome reversal pressure.

An advantage of the present disclosure is that it reduces the angularity of the inner leg portion of the bottom of the container body relative to the central axis of the container. Another advantage of the present disclosure is that it increases the length of the inner leg portion combined with the frusto-conical portion of the invention. Another advantage of the present disclosure is that it increases the buckle strength of the container body. Another advantage of the present disclosure is that it increases the dome reversal pressure of the container body. Another advantage of the present disclosure is that it allows for reduction in the amount of metal required to manufacture the bottom structure of the container body. Another advantage of the present disclosure is that it achieves improved performance and material savings without the need for additional reforming steps. Other advantages of the present disclosure will become apparent from the following descriptions, taken in connection with the accompanying drawings, wherein, by way of illustration and example, an embodiment of the present disclosure is disclosed.

For all purposes intended to facilitate understanding of the disclosure herein presented, the following definitions of terms are given: The terms "Container" and "can" are used interchangeably. "Container stand plane" means an imaginary plane perpendicular to the longitudinal central axis 1 16 of the container, and intersecting the axis at the lowermost point of the container. In example, the surface of a table upon which the container was placed in an upright position, would be the "container stand plane." As related especially to elements of the container, "downwardly" means a direction towards the container stand plane, and "upwardly" means a direction away from the container stand plane. Likewise, "outwardly" means a direction away from the longitudinal central axis 116 of the container, and "inwardly" means a direction towards the longitudinal central axis 116 of the container. The phrase "extends from adjacent" or similar phrases are intended to refer to the situation where two portions of an article are either attached to each other or connected by one or more connecting portions such as transitional radii, chamfers, or the like.

In a preferred embodiment of the present disclosure, a container is disclosed, having a sidewall portion and a bottom structure of a unique configuration. The bottom structure has a domed central panel in its center. The outer edge of the central panel is attached to the upper edge of a downwardly inclined frusto-conical portion. The frusto-conical portion is attached at its lower edge to the upper edge of a substantially cylindrical inner leg portion. The lower edge of the inner leg portion is attached to the inside edge of a downwardly inclined generally semi-toroidal nose portion. A cross-section of the nose portion may be semicircular, or it may include a combination of other linear and non-linear components in forming a ring upon which the container will rest upright on horizontal surfaces. The outer edge of the nose portion is attached to the lower edge of an upwardly inclined outer leg portion. The outer leg portion may be generally cylindrical or substantially curvaceous, and may include those shapes generated by a secondary reforming step. The upper edge of the outer leg portion is attached to the lower end of the sidewall portion. The sidewall portion comprises a generally cylindrical wall extending axially about the centerline of the container. The upper end of the sidewall is a free edge defining a mouth of the container. The attachment of the lower end of the sidewall to the bottom structure forms the container.

In another preferred embodiment of the present disclosure, a semi-toroidal outer radius is disposed between the chamfer portion and the inner leg portion.

In another preferred embodiment of the present disclosure, a semi-toroidal inner radius is disposed between the chamfer portion and the central panel, and a semi-toroidal outer radius is disposed between the chamfer portion and the inner leg portion.

In another preferred embodiment of the present disclosure, a dome plug for manufacturing the disclosed container is disclosed. The dome plug comprises a semi-spherical dome portion. Alternatively, the dome plug may be comprised of multiple layers of spherical segments or other geometric combinations that render a relatively smooth dome. The dome portion is attached at its base to a chamfered portion. The chamfered portion angles outwardly from its attachment to the semi-spherical portion. The opposite, lower end of the chamfered portion is attached to a cylindrical base portion.

In another preferred embodiment of the present disclosure, a semi-toroidal inner dome radius is positioned in tangentially smooth transition between the dome portion and the chamfered portion.

In another preferred embodiment of the present disclosure, a semi-toroidal outer dome radius is positioned in tangentially smooth transition between the chamfered portion and the base portion.

In another preferred embodiment of the present disclosure, a semi-toroidal inner dome radius is positioned in tangentially smooth transition between the dome portion and the chamfered portion, and a semi-toroidal outer dome radius is positioned in tangentially smooth transition between the chamfered portion and the base portion.

In another preferred embodiment of the present disclosure, a bottom forming tooling assembly for manufacturing the container of the present disclosure is disclosed. A dome plug comprises a semi-spherical dome portion attached at its base to a chamfered portion. The chamfered portion angles outwardly from its attachment to the semi-spherical portion. The opposite, lower end of the chamfered portion is attached to a generally cylindrical base portion. The dome plug may include an inner dome radius and outer dome radius portions for tangentially smooth transition on opposite ends of the chamfered portion.

A hollow punch nose comprises an outer punch-contact surface portion for complimentary attachment to a punch. The punch nose has a hollow center defined by a unique inner surface configuration. The hollow center is formed in part by a generally cylindrical central relief surface. The bottom of the central relief surface is attached to a conical coining surface, which angles downwardly and outwardly. The bottom of the conical coining surface is attached to a cylindrical inner leg-forming surface. The bottom of the inner leg-forming surface is attached to the inside of a generally semi-toroidal nose-forming portion. The nose forming portion may be semicircular, or it may include a combination of other linear and non-linear components. The outside of the nose-forming portion is attached to an upwardly inclined outer leg-forming portion. The upper end of the outer leg-forming portion is attached to the punch contact surface portion.

In another preferred embodiment of the present disclosure, the inside diameter of the inner leg-forming surface is no more than about 0.110 inches greater than the outside diameter of the cylindrical base portion of the dome plug.

In another preferred embodiment of the present disclosure the height of the inner leg-forming surface is at least about 0.09 inches.

BRIEF DESCRIPTION OF THE SEVERAL VIEWS OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE INVENTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present disclosure is not intended to be limited to the embodiments shown, but is to be accorded the widest scope consistent with the principles and features disclosed herein.

Figure 1:
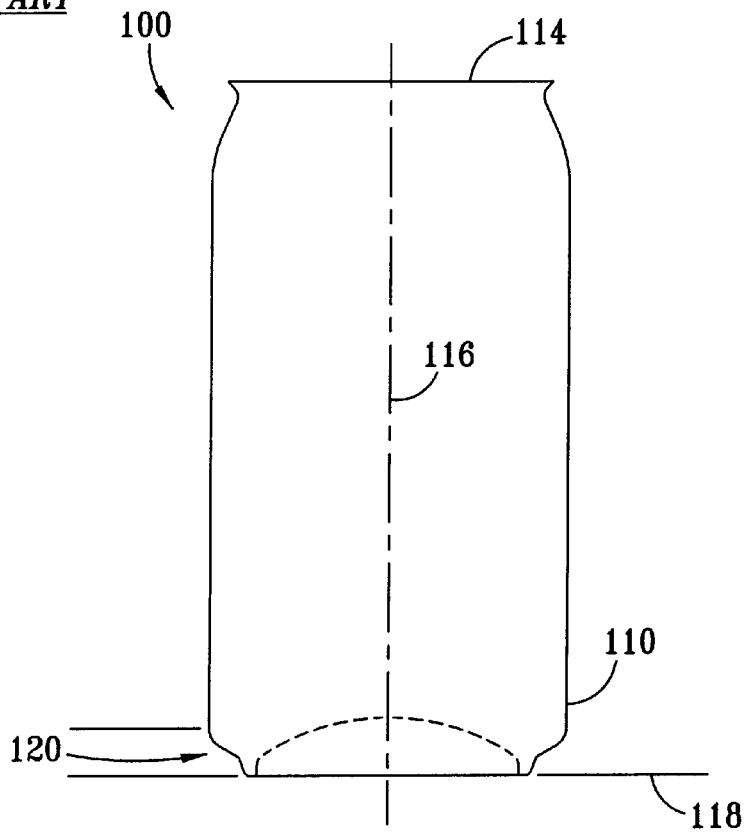
FIG. 1 PRIOR ART
FIG. 1 is a cross-sectional side view of a container in which the preferred embodiment may be used. The preferred embodiment is not shown in FIG. 1 because it can not readily be seen on the scale of FIG. 1.

FIG. 1 is a side cross-sectional view of a container 100, in which the preferred embodiment may be used. Container 100 is an open-ended vessel having a sidewall portion 110 and a bottom structure 120, which is of a unique configuration. Container 100 has an open-ended mouth portion 114 at its uppermost end. Mouth portion 114 is integrally attached to generally circumferential sidewall portion 110. Sidewall portion 110 is attached at its lowermost end to bottom structure 120, thus forming an open-ended vessel. Container 100 has a longitudinal central axis 116, which is perpendicular to a container stand plane 118. The design of bottom structure 120 is further detailed in FIG. 3.

Figure 2:
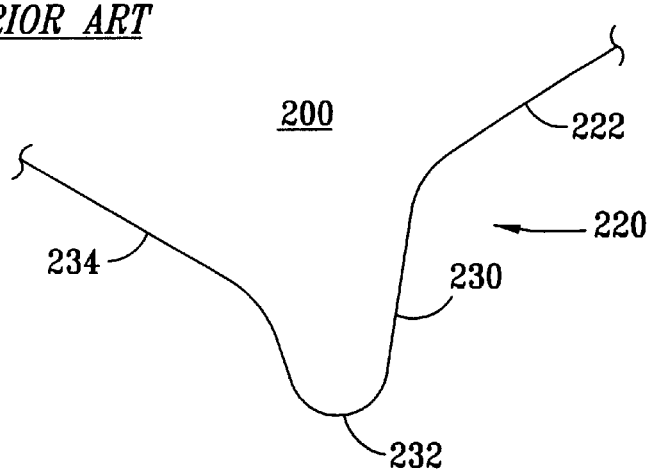
FIG. 2 PRIOR ART
FIG. 2 is an enlarged cross-sectional side view of a portion of a prior art container showing the configuration of known container bottom profiles.

FIG. 2 is a side view of a container 200 comprising the previously known technology. More specifically, FIG. 2 is an enlarged cross-sectional side view of a bottom structure 220 of container 200. In this view, the detail of bottom structure 200 is shown. A domed central panel 220 forms the center of bottom structure 220. Central panel 222 is attached at its outermost circumference to an inner leg portion 230. Inner leg portion 230 is attached at its lower edge to the inner edge of a generally semi-toroidal nose portion 232. Nose portion 232 is attached at its outer edge to an outer leg portion 234. Outer leg portion 234 is attached to a sidewall portion 210 not shown.

Figure 3:
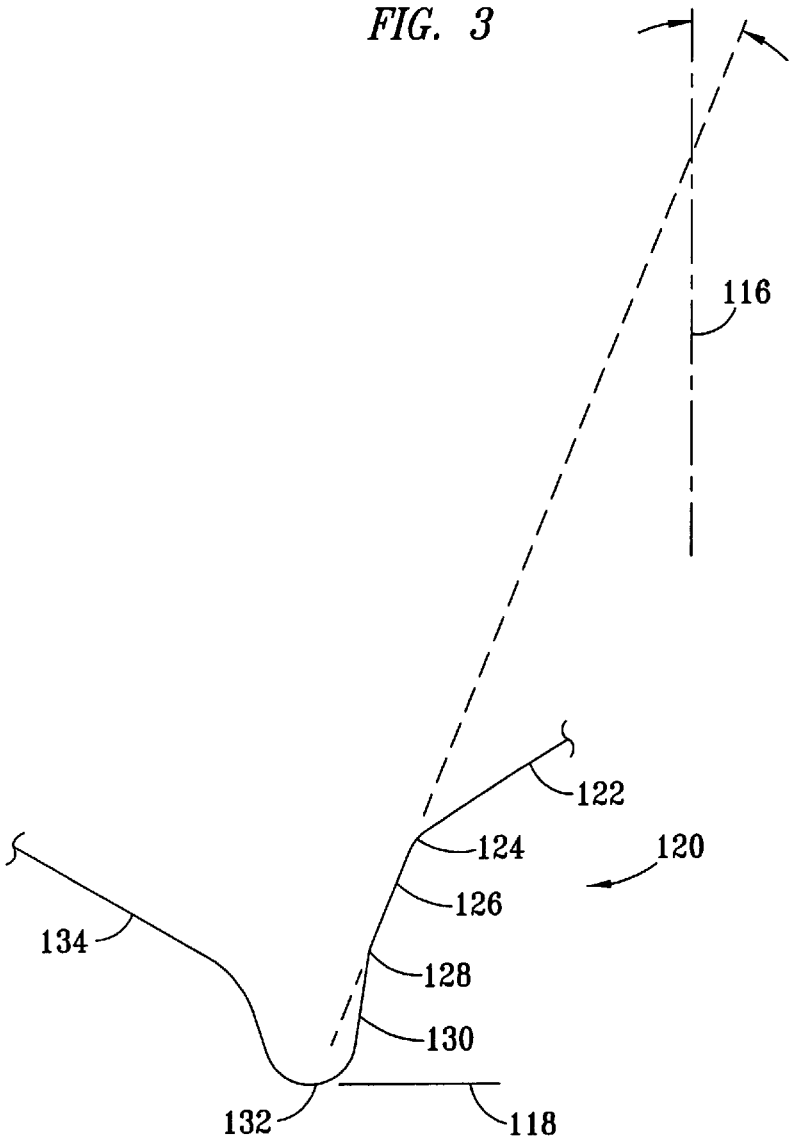
FIG. 3 is an enlarged cross-sectional side view of the section indicated in FIG. 1, of the improved container of the preferred embodiment.

FIG. 3 is an enlarged cross-sectional side view of bottom structure 120 of the preferred embodiment as indicated in FIG. 1. As can be seen in this view, and in FIG. 1, a domed central panel 122 forms the center of bottom structure 120. The outer edge of central panel 122 is attached to a semi-toroidal inner radius 124. Inner radius 124 is disposed between central panel 122 and the upper edge of an outwardly and downwardly inclined frusto-conical portion 126. While preferred, inner radius 124 is not required and may be replaced by a chamfered portion, or frusto-conical portion 126 may be attached directly to central panel 122. Frusto-conical portion 126 extends axially outwardly and downwardly from adjacent to central panel 122. Frusto-portion 126 is inclined outwardly and downwardly from longitudinal central axis 116 of container 100 at angle $\alpha$. The preferred angle $\alpha$ is about 14.5°. However, angle $\alpha$. may be from about 5° to about 25°. More preferably, angle $\alpha$ is from about 10° to about 20°. Most preferably angle $\alpha$ is from about 13° to about 16°. Frusto-conical portion 126 is attached at its lower edge to a semi-toroidal outer radius 128. Outer radius 128 is disposed between frusto-conical portion 126 and the upper edge of a substantially cylindrical inner leg portion 130. While preferred, outer radius 128 is not required may be replaced by a chamfered portion, or frusto-conical portion 126 may be attached directly to inner leg portion 130. The lower edge of inner leg portion 130 is attached to the inside edge of a downwardly inclined generally semi-toroidal nose portion 132. A cross-section of nose portion 132 may be semicircular, or it may include a combination of other linear and non-linear components in forming a structure that at its lowest point is tangent to container stand plane 118. Nose portion 132 thus forms a "ring" upon which container 100 may rest upright on horizontal surfaces. The outer edge of nose portion 132 is attached to the lower edge of an upwardly inclined outer leg portion 134. Outer leg portion 134 may be generally cylindrical or substantially curvaceous, and may include those shapes generated by a secondary reforming step. The upper edge of outer leg portion 134 is attached to the lower end of sidewall portion 110, shown in FIG. 1, thus forming an open-ended vessel.

Figure 4:
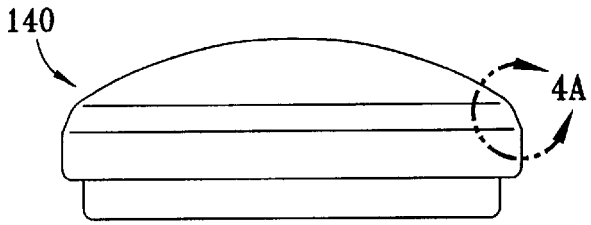
FIG. 4 is an enlarged cross-sectional side view showing the chamfering of the dome plug of the preferred embodiment in comparison with the dome plug of the prior art.
Figure 4A:
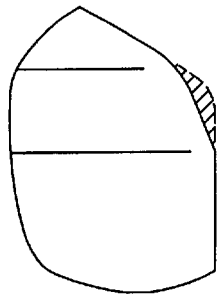

FIG. 4 is an enlarged cross-sectional side view of a dome plug 140. In this view, one of the differences between dome plugs of the previously known technology and dome plug 140 of the preferred embodiment can be seen. The shaded portion of FIG. 4 indicates the portion of previous dome plugs removed to form dome plug 140 of the preferred embodiment.

Figure 5:
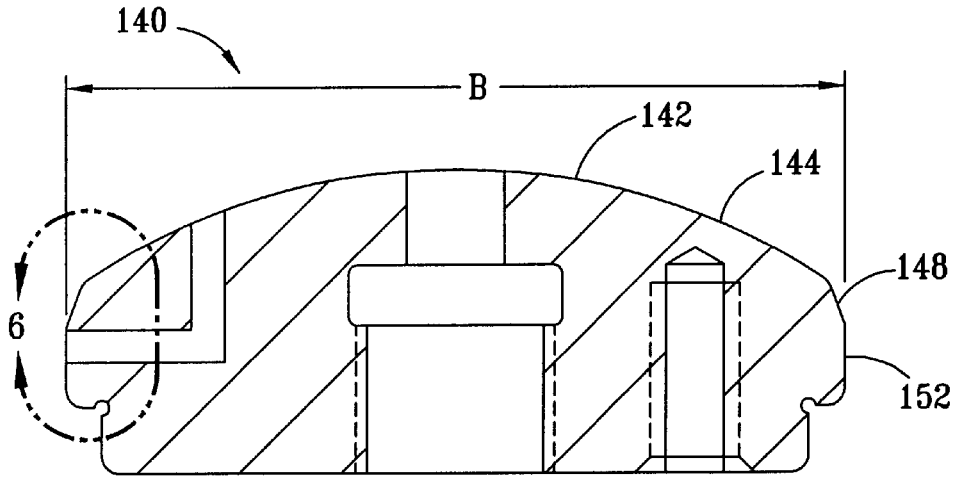
FIG. 5 is a drawing of a dome plug of the preferred embodiment, demonstrating the improved chamfering.
Figure 6:
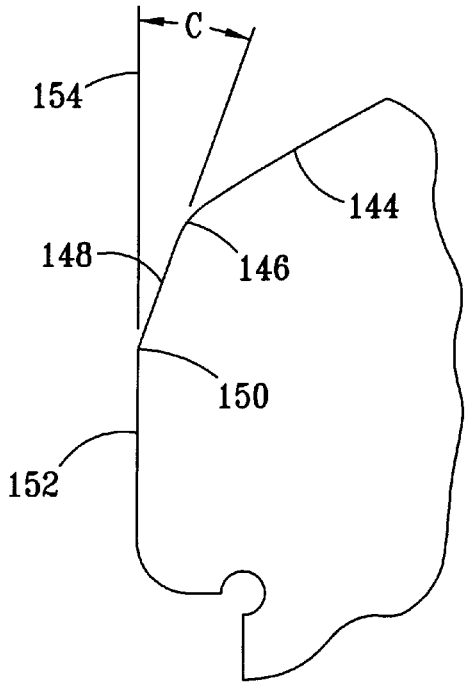
FIG. 6 is an enlarged cross-sectional side view of the section indicated in FIG. 5, of a dome plug of the preferred embodiment.

FIG. 5. is a cross-sectional side view of a dome plug 140. Dome plug 140 is designed for manufacturing disclosed container 100. Dome plug 140 has a generally semi-spherical dome portion 142. Dome portion 142 may be comprised of more than one spherical segment, having for example, a secondary spherical-segment portion 144. As seen in FIG. 6, dome portion 144 is attached at its outermost circumference to an inner dome radius 146. The opposite end of inner dome radius 146 is attached to a chamfered portion 148. Inner dome radius 146 provides a smooth transition from dome portion 144 to chamfered portion 148. The angle defined by chamfered portion 148 with respect to a vertical axis 154 of dome plug 140 is defined by angle "C." In the preferred embodiment, this angle may range from about 5° to about 25°. The outermost edge of chamfered portion 148 is attached to outer dome radius 150. Outer dome radius 150 provides a smooth transition from chamfered portion 148 to a generally cylindrical base portion 152. Alternatively, outer dome radius 150 can be omitted or replaced by a small chamfer. Referring to FIG. 5, dimension B represents the diameter of cylindrical base portion 152.

Figure 7:
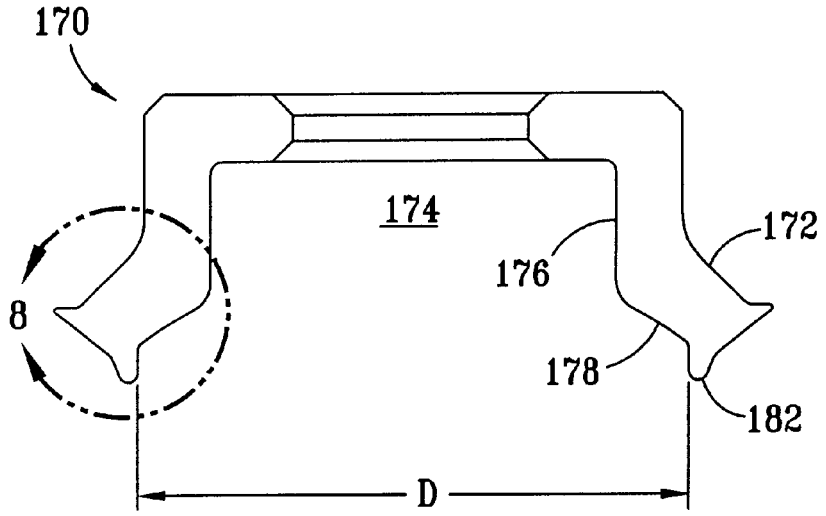
FIG. 7 is a drawing of a punch nose of the preferred embodiment.

FIG. 7. is a cross-sectional side view of a hollow punch nose 170. Punch nose 170 has an outer punch-contact surface portion 172 for complimentary attachment to a punch (not shown). Punch nose 170 has a hollow center 174 defined by a unique inner surface configuration. Hollow center 174 has a generally cylindrical central relief 176. The bottom of central relief 176 is attached to a conical coining surface 178, which angles downwardly and outwardly. A radiused transition may be used to form a smooth transition between central relief 176 and conical coining surface 178.

Figure 8:
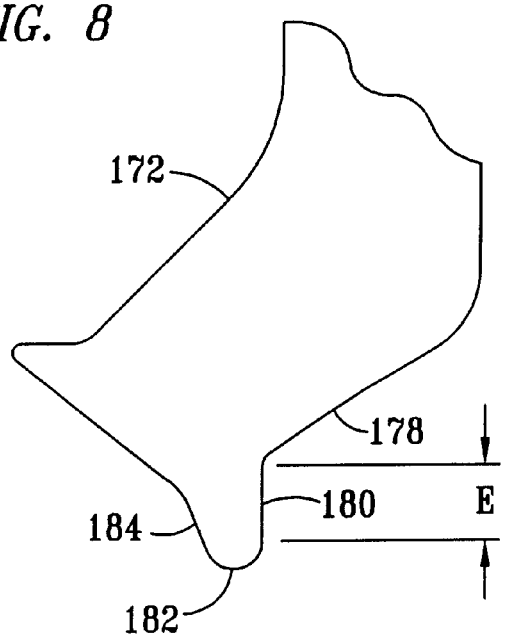
FIG. 8 is an enlarged cross-sectional side view of the section indicated in FIG. 7, of a punch nose of the preferred embodiment.

Referring to FIG. 8, the bottom of the conical coining surface 178 is attached to a cylindrical inner leg-forming surface 180. A radiused transition may be used to form a smooth transition between of conical coining surface 178 and inner leg-forming surface 180. The bottom of inner leg-forming surface 180 is attached to the inside of a generally semi-toroidal nose-forming portion 182. Nose forming portion 182 may be semicircular, or it may alternatively include a combination of other linear and non-linear components.

The outside of nose-forming portion 182 is attached to an upwardly inclined outer leg-forming portion 184. The upper end of outer leg-forming portion 184 is attached to punch contact surface portion 172.

In the preferred embodiment of the present disclosure, the inside diameter of inner leg-forming surface 180 (dimension D) is no more than about 0.0354 inches greater than the outside diameter of base portion 152 of dome plug 140 (see FIG. 5, dimension B).

In another preferred embodiment of the present disclosure the height of inner leg-forming surface 180 (see FIG. 8. Dimension E) is at least about 0.09 inches.

Operation of the Invention

In the preferred embodiment of the present disclosure, container 100 is provided being comprised of generally of sidewall portion 110 and bottom structure 120. Bottom structure 120 is comprised of central panel 122 attached by inner radius 124 to frusto-conical portion 126 which is essential to the present invention. Frusto-conical portion 126 is attached by outer radius 128 to inner leg portion 130. Inner leg portion 130 is attached to nose portion 132. Nose portion 132 defines the lowermost extent of container 100 and forms a "ring" upon which container 100 may rest upright on horizontal surfaces. The outer edge of nose portion 132 is attached to the lower edge of an upwardly inclined outer leg portion 134. Leg portion 134 is attached to sidewall portion 110, thus forming container 100.

In the preferred embodiment, inner leg portion 130 is more vertically oriented than previously known designs that were manufactured using similar manufacturing methods and tooling before any secondary reform processing steps. In a preferred embodiment inner leg portion 130 will be oriented at an angle between from about −5° to about 0° after the secondary reform process. Before the secondary reform process, the inner leg portion 130 has an angle from about −1° to about 4° with respect to the longitudinal central axis 116 of the container. In comparison, inner leg portion 230 is oriented at an angle from about 0° to about 2° relative to longitudinal central axis of container 200 of the prior art after application of the same secondary reform processing step. Also, inner leg portion 130, combined with the vertical component of frusto-conical portion 126 is longer than previously known designs. Also, inner leg portion 130 has a larger inside diameter than previously known These dimensional changes, in combination with the presence of frusto-conical portion 126, provide container 100 with improved operating characteristics.

The unexpected aspect of the invention was the magnitude of the increase in the dome reversal pressure that was achieved. For example, tests performed on the preferred embodiment as disclosed, indicate an increase in dome reversal pressure from 94.5 psi to 99.7 psi for containers made using aluminum feedstock having a thickness of 0.0104 inches and an increase in dome reversal pressure from 91.4 psi to 97.8 psi for containers made using aluminum feedstock having a thickness of 0.0102 inches. These measurements were taken on containers that had their bottom profiles reformed using an outside reform process. While the container bottom of the invention provides increased strength without an additional outside reforming step, the preferred method includes both the modified container bottom described herein combined with known outside reform processes. However, the only variables were the change in initial bottom profile and the feed stock thickness. These tests show that the feed stock thickness required to manufacture container 100 could be reduced by 0.0002" (two ten thousandths of an inch) while having an increase in dome reversal pressure from 94.5 psi to 97.8 psi.

The inventors devised container 100 and a method for manufacturing container 100, such that inner leg portion 130 would be more vertically oriented than previously known designs, by reducing the clearance between base portion 152 of dome plug 140 and inner leg forming portion 180 of punch nose 170. To achieve this, dome plug 140 has a base portion 152 with a diameter that is 0.020" (twenty thousandths of an inch) larger in diameter than the dome plug used to create previously known designs. However, it was determined that this alteration would prohibit proper drawing of the metal, for which previously known clearance was provided. Chamfered portion 148 on dome plug 140 provides angular relief that allows the feed stock metal of container 100 to retain the necessary metallurgical integrity to flow through the restricted clearance between base portion 152 of dome plug 140 and inner leg forming portion 180 of punch nose 170. In addition, chamfered portion 148 on dome plug 140 generates frusto-conical portion 126 onto bottom structure 120 of container 100. Since the angle of inner leg 130 must flatten outwardly as container 100 is pressurized for inversion to occur, the improved vertical orientation of inner leg 130 results in superior buckle performance over previously known designs formed by the same process. Frusto-conical portion 126 acts to further increase dome reversal pressure by providing an additional vertical component to the height of central panel 122, and by providing a discontinuity in the structure of central panel 122 that mechanically resists inversion.

In previous container bottom profiles, the top of the central panel is 0.425 inches above the container stand plane. In the design for container 100 disclosed herein, the top of central panel 122 is 0.435 inches above the container stand plane 118. The 0.010 inch increase in the height of central panel 122 is a result of the increase in the combined length of inner leg portion 130 and the vertical component of frusto-conical portion 126. This is achieved by recessing coining surface 178 of punch nose 170 by 0.010" (ten thousandths of an inch) compared to punch nose tooling of previously known designs.

The combination of these modifications results in a bottom profile which has improved strength characteristics similar to that achieved by an "inside reformed" bottom profile without the additional process step of inside reforming.

While this invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

We claim:

1. An integral container bottom comprising;

a central panel;

a frusto-conical portion extending from adjacent the circumference of the central panel, the frusto-conical portion angling downwardly and outwardly from the longitudinal central axis 116 of the central panel at an angle of less than about 25° (twenty-five degrees) therefrom;

a substantially cylindrical inner leg portion extending from adjacent to the outer edge of the frusto-conical portion;

a downwardly inclined generally semi-toroidal nose portion extending from adjacent to the inner leg portion;

an outer leg portion having a lower edge and an upper edge, the outer leg portion extending from adjacent to the outside edge of the nose portion; and, a generally cylindrical sidewall portion of the container body extending from adjacent to the upper edge of the outer leg portion.

2. A container bottom according to claim 1, wherein;

the angle formed between the frusto-conical portion and the vertical central axis of the central panel ranges between about 10° (ten degrees) and about 20° (twenty degrees).

3. A container bottom according to claim 1, further comprising;

a semi-toroidal inner radius disposed between the central panel and the frusto-conical portion to provide a smooth transition therein.

4. A container bottom according to claim 3 wherein;

the inner radius ranges from about 0.030 inches to about 0.070 inches (about thirty thousandths of an inch to about seventy thousandths of an inch).

5. A container bottom according to claim 1, further comprising;

a semi-toroidal outer radius disposed between the frusto-conical portion and the inner leg portion to provide a smooth transition therein.

6. A container bottom according to claim 5, wherein;

the outer radius ranges from about 0.010 inches to about 0.050 inches (about ten thousandths of an inch to about fifty thousandths of an inch).

7. A container bottom according to claim 1, wherein;

the angle formed between the inner leg and the longitudinal central axis 116 of the central panel is less than about 3° (three degrees).

* * * * *